United States Patent [19]

Mathis

[11] Patent Number: 4,917,346

[45] Date of Patent: Apr. 17, 1990

[54] CONCRETE FORM SHUTTERING

[75] Inventor: Hugo Mathis, Bregenz, Austria

[73] Assignee: Rund-Stahl-Bau Gesellschaft m.b.H.

[21] Appl. No.: 163,821

[22] PCT Filed: Jun. 12, 1987

[86] PCT No.: PCT/EP87/00309

§ 371 Date: Feb. 17, 1988

§ 102(e) Date: Feb. 17, 1988

[87] PCT Pub. No.: WO87/07922

PCT Pub. Date: Dec. 30, 1987

[30] Foreign Application Priority Data

Jun. 17, 1986 [AT] Austria ..... A1653/86

[51] Int. Cl.[4] ..... E04G 11/20

[52] U.S. Cl. ..... 249/20; 249/17; 249/44; 249/49; 249/153; 249/157; 249/179; 249/182; 249/184; 264/32; 425/65

[58] Field of Search ..... 249/17, 19, 20, 44, 249/47, 144, 152, 153, 161, 164, 157, 179, 182, 184, 193, 194, 49; 425/63, 65; 264/32, 33

[56] References Cited

U.S. PATENT DOCUMENTS

| | | | |
|---|---|---|---|
| 2,742,985 | 5/1988 | Mathis | 249/193 |
| 3,252,199 | 5/1966 | Bössner | 425/65 |
| 4,374,634 | 2/1983 | Ahl | 425/65 |
| 4,540,150 | 9/1985 | Tzincoca | 249/20 |
| 4,562,989 | 1/1986 | Scheller | 249/19 |
| 4,611,784 | 9/1986 | Gallis | 249/20 |

FOREIGN PATENT DOCUMENTS

| | | | |
|---|---|---|---|
| 2645910 | 4/1977 | Austria . | |
| 602963 | 9/1934 | Fed. Rep. of Germany | 249/17 |
| 1292634 | 4/1969 | Fed. Rep. of Germany | 249/20 |
| 8604378 | 7/1986 | PCT Int'l Appl. . | |

*Primary Examiner*—James C. Housel

*Attorney, Agent, or Firm*—Toren, McGeady & Associates

[57] ABSTRACT

A form for erecting structures having an plan shape, any generatrix and possibly changing wall thickness includes an inner form (1) and an outer form (2). Circumferentially closed support rings (5,6) are arranged horizontally spaced from the inner form as well as from the outer form. Radially aligned sleeves (35) are provided in the support rings (5,6). Threaded spindles (7,8) are slidably but fixedly held in the sleeves (35). One end of each threaded spindle (7,8) engages form carriers (11,12) which rest against the form carriers (3,4). The inclination of the form plates (3,4) or the wall thickness of the structure to be erected can thus be adjusted. Web members (13,14) are provided between the form plates (3,4) in circumferential direction of the form, the web members engaging over the form plate edges at the rear sides thereof. The web members have a support (15,16) on the surface facing the structure in the region between the side edges of the spaced-apart form plates (3,4). The thickness of the support (15,16) corresponds approximately to the thickness of the form plates (3,4).

27 Claims, 6 Drawing Sheets

Fig. 16
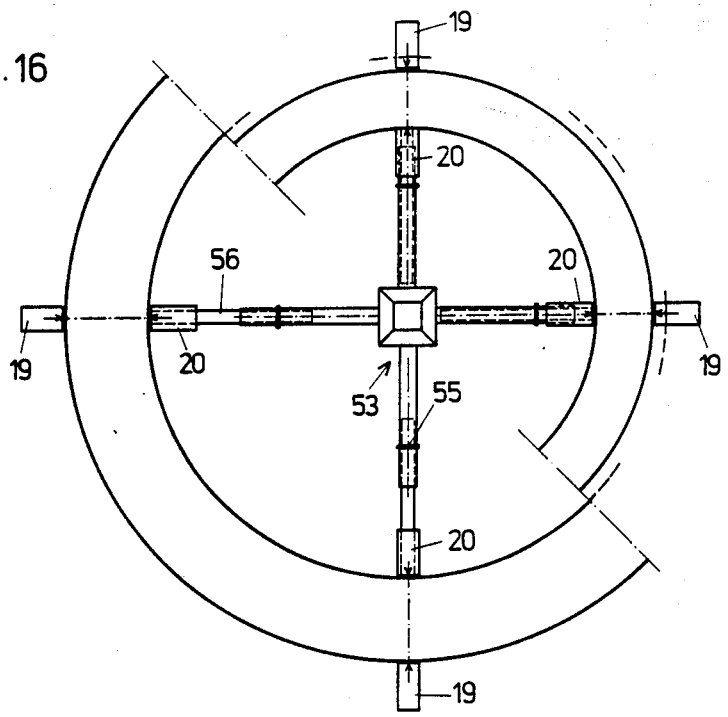
Fig. 17
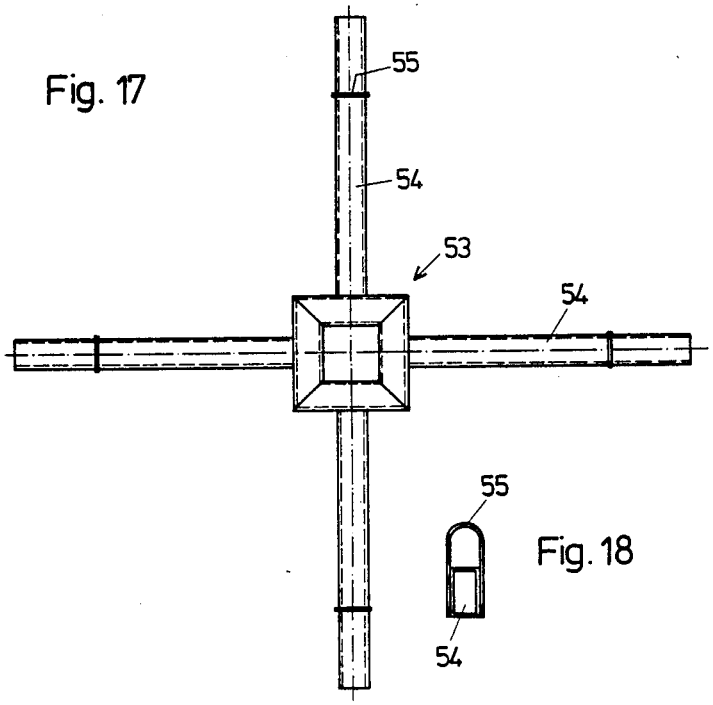
Fig. 18

CONCRETE FORM SHUTTERING

The invention relates to a shuttering or form for erecting structures of any plan shape, any generatrix and possibly changing wall thickness, including a form framework for an inner form and/or an outer form and a plurality of form plates which overlap each other in horizontal direction.

A sliding form for the manufacture of structures of this type is already known. This form includes lifting stands which are slidable on horizontal guides transversely of the wall and a form whose length can be changed and which is adjustable relative to the wall. These lifting stands are constructed similar to a parallelogram with articulated corner points, so that the horizontally extending parts of the lifting stands are always horizontal and the other parts of the lifting stands extend parallel to the inclined wall. Accordingly, the adjustment for the inclination of the form is quite complicated because all lifting stands to be arranged on the circumference of the form must be adjusted in accordance with the appropriate inclination. In addition, it must be taken into consideration that all these lifting stands together with the form are suspended with a concreting platform, so that not only the further conveyance but also the new adjustment after each section of the structure are particularly difficult.

Therefore, it is the object of the present invention to provide an exactly and simply adjustable form which can be adapted after each section of the structure to changing inclinations, changing wall thicknesses, etc.

In accordance with the invention, this object is met by arranging circumferentially closed, force-transmitting support rings which are horizontally spaced apart at the inner form and/or the outer form. Threaded spindles are held in the support rings so as to be slidable in approximately horizontal direction and fixable, wherein one end of the threaded spindles engage the form plates or the form supports resting against the form plates. Between the form plates seen in circumferential direction of the form, web members are provided which engage over the edges of the form plates at the rear sides thereof. In the region between the side edges of adjacent spaced-apart form plates, each web member has on its surface facing the structure a support which corresponds in thickness to the form plates.

The measures according to the invention make possible an exact adaptation of the form to a certain plan shape, to a certain generatrix and to a changing wall thickness because an exact adjustment of the form relative to the support rings is possible. The support rings do not have to carry out a carrying function; accordingly, they do not support the form itself, but rather are suspended from the form and serve only to fix the form plates in the desired position. As a result, a very exact adjustment of the form to various inclinations of the wall to be constructed, to any plan shapes and possibly to changing plan shapes, to constant wall thicknesses or changing wall thicknesses if possible. Also contributing to the simple construction of such a form is the fact that a simple changing of the diameter or the circumference of such a structure and, thus, a corresponding adjustment of the form is possible, because the form plates may have the same size over the entire height of the structure, so that only the web members provided for bridging the spaces between the edges of the form plates must be adjusted. A satisfactory surface of the structure is obtained because the web members have a support which corresponds approximately in thickness to the form plates, the support being provided between the side edges of the form plates on the surfaces of the web members facing the structure. Due to the arrangement of such a support, a simple adaptation to the changing spaces between the edges of the form plates is possible because these supports can be adjusted accordingly. The web members may then continue to engage over the edge portions of the form plates.

The form according to the invention can be used without requiring anchors extending through the structure because only a support of the form in vertical direction must be provided. The support rings conduct the force emanating from the form, so that, contrary to known forms, a connection extending through the structure between the outer form and the inner form is not necessary.

Further features according to the invention and particular advantages shall be explained in more detail in the following description with the aid of the drawings. In the drawings:

FIG. 16 is a top view of a carrying member for an inner platform, wherein the use in a conical structure in the lowermost region and the uppermost region thereof is illustrated;

FIG. 17 is an enlarged top view of the carrying structure of the inner platform;

FIG. 18 is a side view of an arm of this carrying structure.

FIGS. 19 and 20 each show an articulated joint between the threaded sleeves and the form carriers.

Figure 1:
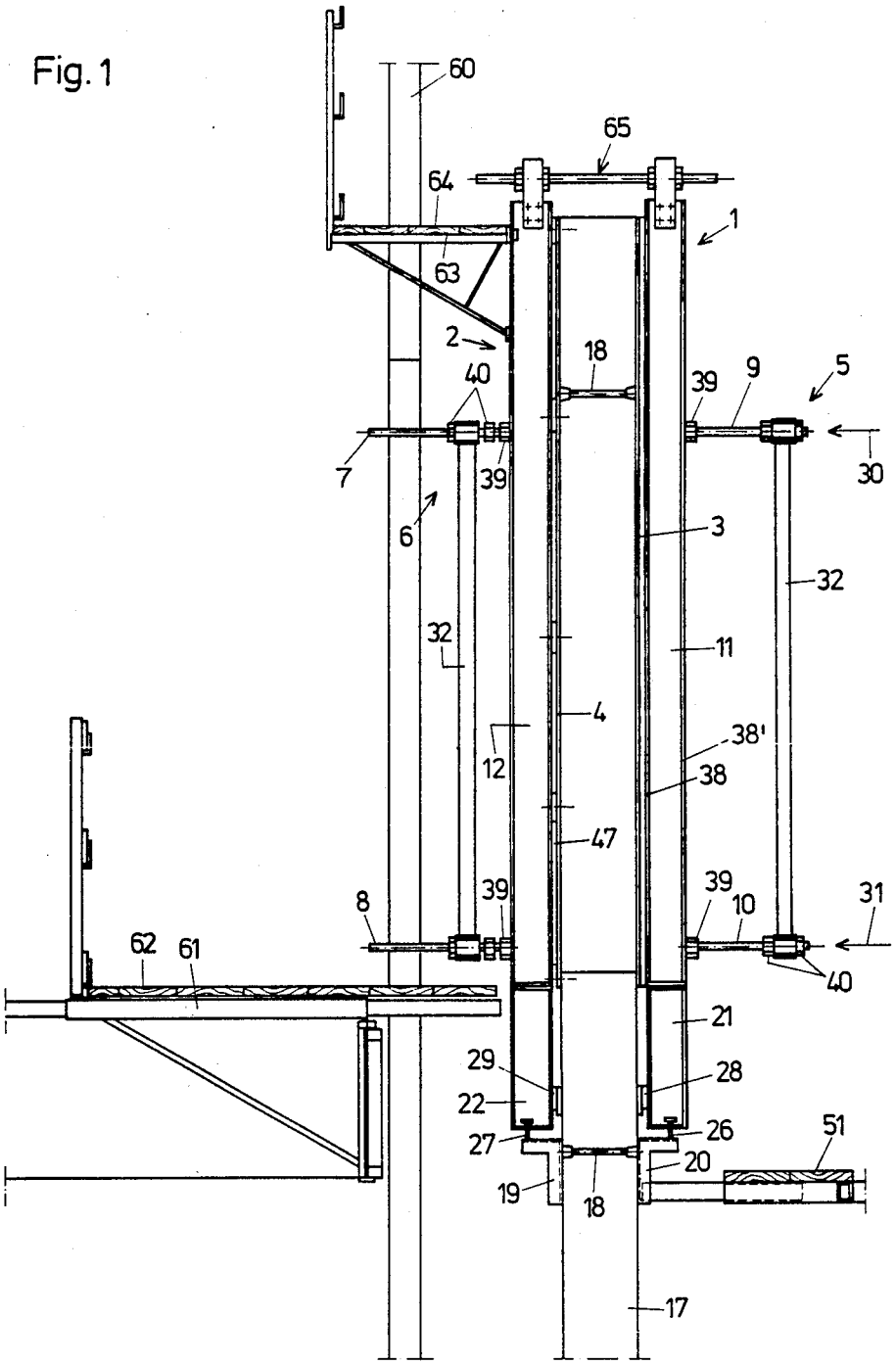
FIG. 1 is a sectional view of the form according to the invention, wherein an inner form and an outer form are illustrated.
Figure 2:
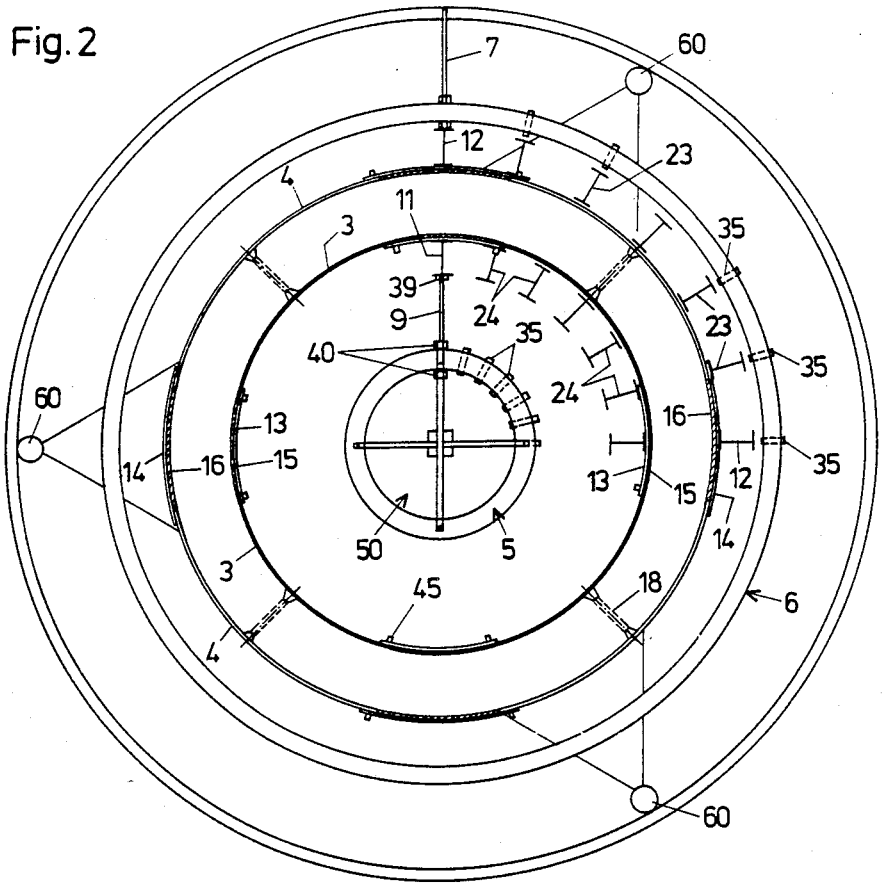
FIG. 2 is a top view of such a form for an annular structure.

The form illustrated in FIGS. 1 and 2 is intended for erecting a structure which is annular in cross-section, wherein this structure becomes narrower toward the top in the shape of a cone or truncated cone and wherein, in addition, the wall thickness of the structure decreases toward the top. The drawings additionally show an embodiment in which the horizontal generatrices form a circular arc. It would also be conceivable to use such a form for any cross-sectional shape of a structure, for any generatrix and for changing wall thickness.

Accordingly an inner form 1 and an outer form 2 are provided, wherein a form framework composed of several parts, to be explained in detail below, and a plurality of form plates 3 and 4 which engage each other in horizontal direction are provided. At the inner form 1 as well as at the outer form 2 are provided circumferentially closed support rings 5 and 6 which are spaced horizontally from each other. Threaded spindles 7, 8, 9 and 10 are held in the support rings 5 and 6 so as to be slidable approximately in horizontal direction. The free end of each threaded spindle 7 to 10 engages the form plates 3, 4 or form carriers 11, 12 resting against the form plates 3, 4.

Web members 13, 14 engaging over the edges of the form plates at the rear sides thereof are provided between the form plates 3, 4 seen in circumferential direction of the form. The web members 13, 14 have supports 15, 16 which correspond in thickness to the form plates 3, 4. The supports 15, 16 are provided on the surfaces of the web members facing the structure in the region between the side edges of adjacent spaced-apart form plates 3 and 4.

In the following, the individual elements of the form according to the invention shall be explained in more detail.

The form plates 3, 4 are supported through approximately vertically extending form carriers 11, 12 on the ground or on an already finished section 17 of the structure. When the first section of the structure is manufactured, the support is effected on the ground or on an appropriate substructure. Encasing pipes 18 are used in erecting the next following section of the structure, wherein angular carrying members 19, 20 are fastened on the finished section of the structure by means of appropriate screw connections in the region of these encasing pipes 18. Therefore, during the continuing manufacturing of the structure, the form plates 3, 4 can be supported through form carriers 11, 12 on the angular carrying members 19, 20. One support of this type is sufficient for each form plate, with extending pieces 21, 22 being fastened, for example, by a screw connection, to the corresponding form carriers 11, 12 at the underside thereof. The remaining form carriers 23 or 24 following each other with the required spacing do not have to be supported by such carrying members 19, 20, however, it would be possible to provide this type of support for the remaining form carriers 23, 24.

Figure 8:
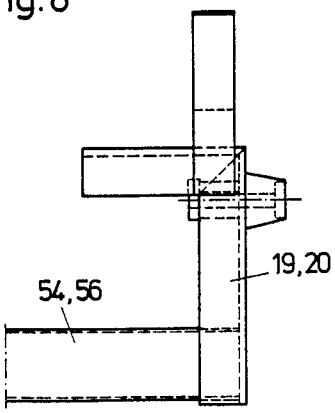
FIG. 8 is an illustration, on a larger scale compared to FIG. 1, of an angular carrying member to be arranged on an already finished section of the structure.
Figure 9:
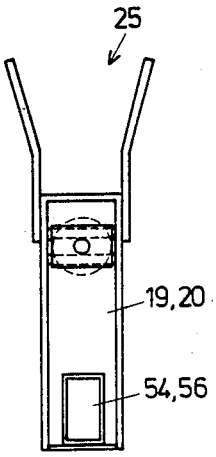
FIG. 9 is a front view of the carrying member of FIG. 8.
Figure 7:
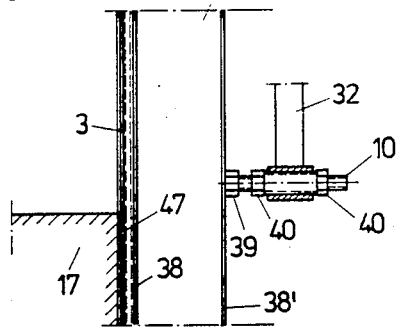
FIG. 7 is a view of a portion of the inner form with the lower portion of a support ring.

Particularly in the case of hydraulic structures where it is not possible to provide anchoring members extending through the structure, or if absolute tightness is ensured, it is possible to use, instead of encasing pipes 18, dead anchoring members which do not extend through the structure. These dead anchoring members are provided at both surfaces of the structure and are used to fasten the angular carrying members 19, 20. As can be seen particularly in FIGS. 8 and 9, the angular carrying members 19, 20 have each a U-shaped, upwardly widening inlet opening 25, so that the form carriers or the extending pieces 21, 22 can be inserted more easily and are held against lateral sliding. To make possible an exact vertical adjustment of the form carriers 11, 12 and, thus, of the form plates 3, 4, the form carriers 11, 12 or the extending pieces 21, 22 have at the underside thereof an adjustable bracing member 26, 27 which rests on the angular carrier member 19, 20. This bracing member 26, 27 advantageously is a threaded spindle, for example, a screw. Thus, a simple vertical adjustment of the form carrier and thus, of the form plates to the required adjustment is possible. After adjusting the vertical position by means of these bracing members 26, 27, the exact spacing of the form carriers 11, 12 from the already finished section 17 of the structure can be fixed by placing wedges 28, 29 between the extending pieces 21, 22 and the already finished structure 17. Instead of the wedges 28, 29, other compensating or adjusting elements can be used for aligning the inclination of the form carrier 21, 22.

Figure 6:
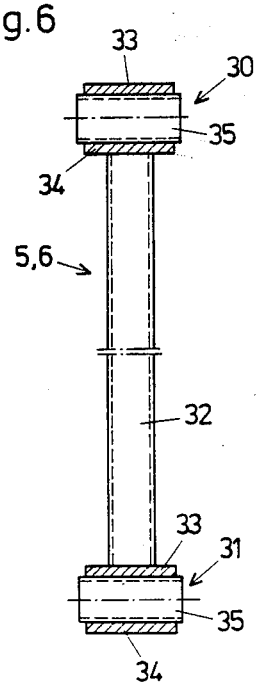
FIG. 6 is a sectional view taken along sectional line II—II in FIG. 4, on a larger scale as compared to FIG. 4.

The support rings 5 and 6 are formed of two rails 30, 31 which extend spaced apart parallel one above the other. Rails 30, 31 are connected to each other by struts 32. These struts 32 may be simple spacer members. Additional struts can be provided if the support rings are large. These support rings can be constructed in a very simple manner because, as can be seen particularly in FIG. 6, the rails 30, 31 are formed by two spaced-apart flat sections 33, 34 arranged one above the other and radially aligned sleeves 35 arranged between the sections 33, 34. These sleeves 35 are provided for the insertion of the threaded spindles 7 through 10. The flat sections 33, 34 can be bent in a circular shape in a simple manner, so that support rings 5, 6 are formed. The inner support ring 5 which, accordingly, is provided for the inner form 6 can be manufactured in one piece, while the outer support ring 6 which is arranged at the outer form 2 advantageously is made of several arc sections which are connected to each other at the joints in the region of the two rails 30, 31. For connecting the arc sections, flanges 36 can be provided. Threaded sleeves 37 or appropriate throughbores can be provided in these flanges for making it possible to screw the arc sections together at the joints. It is also possible to make the inner support ring 5 by combining the inner arc sections.

Figure 4:
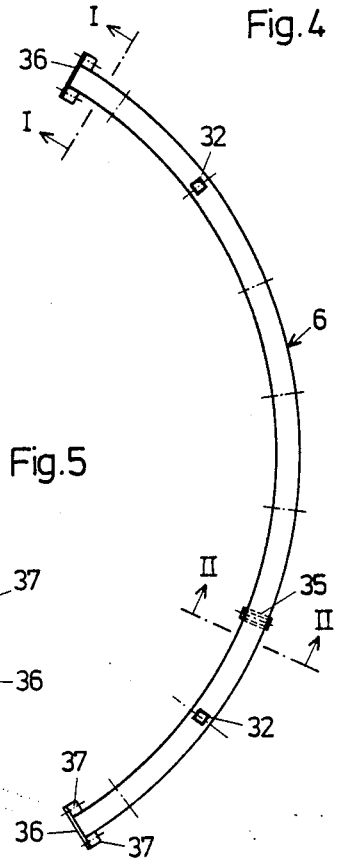
FIG. 4 is a top view of a portion of an outer support
Figure 5:
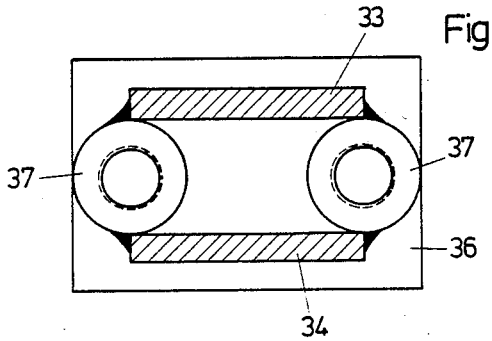
FIG. 5 is a sectional view taken along sectional line I—I in FIG. 4.
Figure 3:
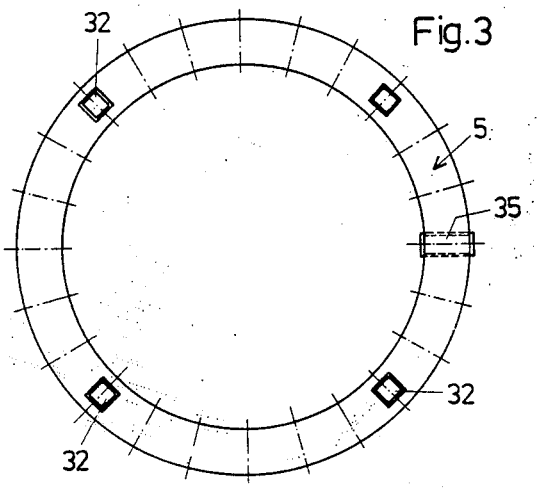
FIG. 3 is a top view of an inner support ring.
Figure 10:
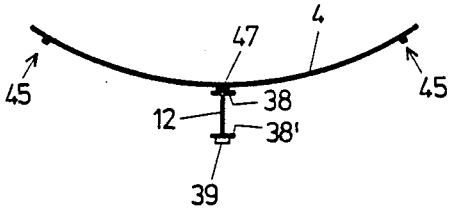
FIG. 10 is a top view of a form plate with a form carrier attached thereto.
Figure 11:
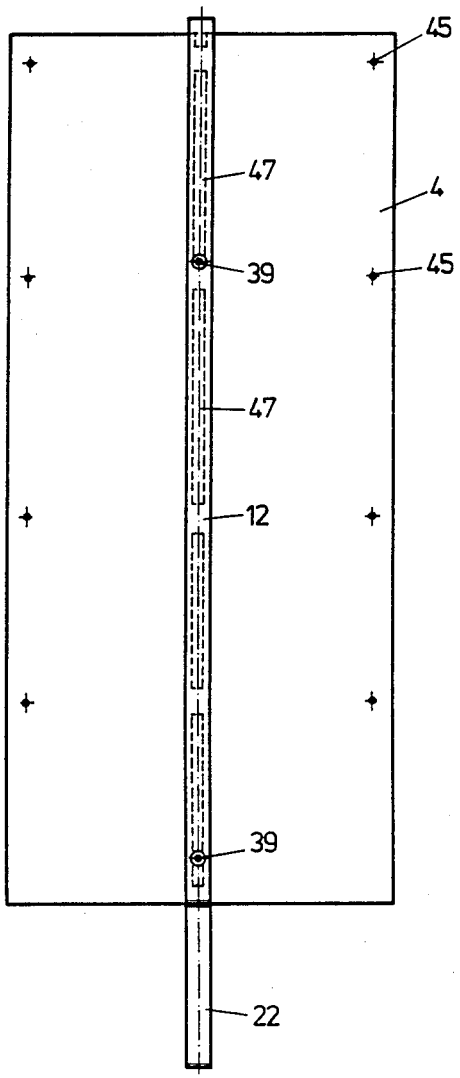
FIG. 11 is a front view of this form plate.
Figure 12:
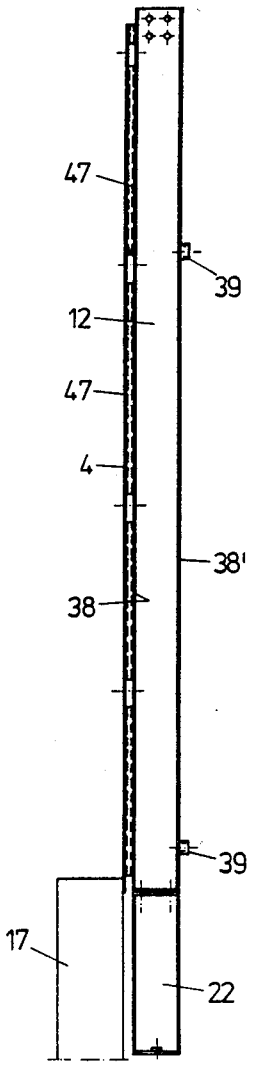
FIG. 12 is a side view of this form plate.
Figure 13:
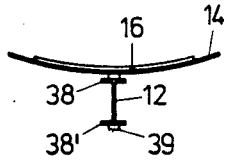
FIGS. 13 to 15 show a web member according to the illustration of FIGS. 10 to 12.
Figure 14:
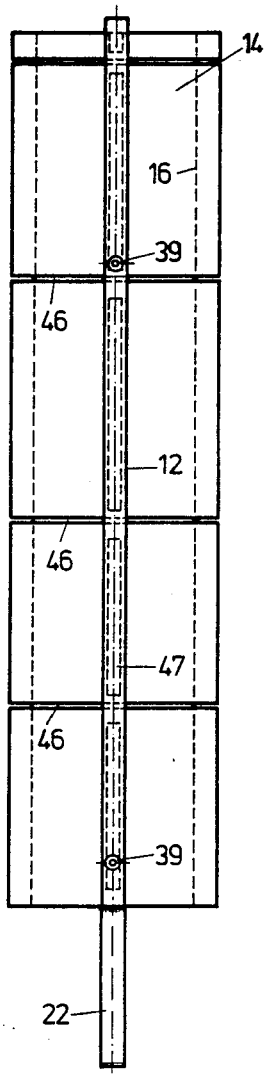
Figure 15:
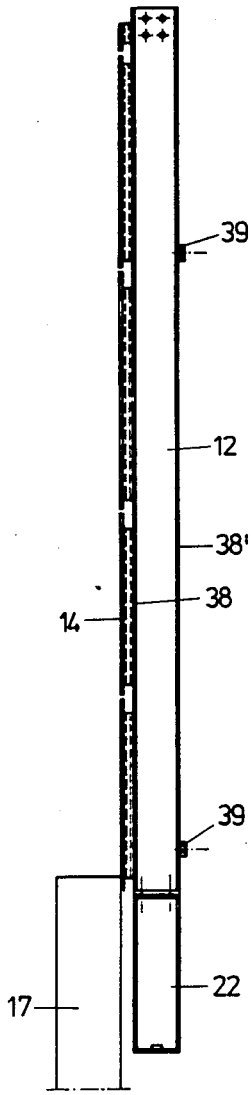

In accordance with the required number of support for the form plates 3, 4, a corresponding number of form carriers 11, 12 and 23, 24 and, thus, a corresponding number of sleeves are provided at the support rings 5, 6. The distribution and arrangement of these sleeves 35 is illustrated in FIGS. 2, 3 and 4 mostly by dash-dot lines.

The form carriers 11, 12, 23, 24 are advantageously constructed as I-beams, wherein one flange 38 is connected to the form plate 4 or the web member 14 and wherein threaded sleeves or nuts 39 for receiving one end each of the threaded spindles 7 through 10 are arranged on the opposite flange 38'. The arrangement of these form carriers over the entire height of the form plates 4 or 14 provides a proper load distribution, so that, for an exact adjustment of the inclination of the form plates 1 or the wall thickness, only two threaded spindles 7, 8 or 9, 10 arranged spaced apart one above the other must be inserted in the corresponding nuts 39 or threaded sleeves, wherein the threaded spindles 7, 8 or 9, 10 are inserted through the sleeves 35 in the support rings 5, 6. An adjustment of the form plates of the form carriers 11, 12 carrying the form plates is not possible. For this purpose, nuts 40 are provided in a simple manner on each threaded spindle 7 through 10 on both sides of the support rings 5 and 6, so that after the appropriate adjustment of the threaded spindle 7 and, thus, of the form plates 3, 4 relative to the support rings 5, 6, an exact fine adjustment and fixing relative to the support rings 5, 6 can be carried out.

Each form carrier 11, 12 arranged in the middle of the respective form plate 3 or 4 seen in circumferential direction of the form is rigidly connected to form plate 3, 4, preferably welded. It is precisely for this reason that only this form carrier 11, 12, arranged in the middle, is supported on the corresponding carrier member 19, 20 arranged therebelow.

Threaded bolts 45 which are arranged spaced apart one above the other are provided at the outer edges of the form plates 3 and 4. Horizontally extending slots 46 are provided at a corresponding distance on the web members 14, 15, so that the overlapping portions of the form plates 3, 4 and of the web members 14, 15 can be clamped together by tightening a nut. This is particularly advantageous in the case of a continuously narrowing diameter, so that the desired circular shape in the cross-section is always maintained. Instead of such threaded bolts 45, projecting flanges can be provided on the form plate 3, 4, wherein the flanges are provided with appropriate openings, so that, for example, wedge members can be placed at the rear side of the overlapping portions.

The threaded bolts 45 preferably are countersunk screws which are inserted into the form plates 3, 4 so as to project freely toward the rear, so that an inner, plane surface of the form plates 3, 4 results.

Spacer webs 47 are mounted between the form carriers 11, 12 and the web members 14, 15 or the form plates 3, 4. The spacer webs 47 are interrupted in the regions of the slot 46 or the threaded bolt 45. These gaps are required practically only in the case of the web members 14, 15, wherein, due to the gaps in the case of greater overlappings of the consecutive form plates and web members, the threaded bolts 45, or the appropriately arranged flanges, can be pushed without impairment of the form carriers 11, 12.

The web members 14, 15 each have a support 15, 16 which faces the section of the structure. The thickness of the support 15, 16 corresponds approximately to the thickness of the form plates 3, 4. Each support 15, 16 is preferably made from a material which can be severed in accordance with the overlapping portions of increasing size of the form plates 3, 4 and the web members 13, 14. Different types of construction can be provided for this purpose. Its support 15, 16 may be formed by a strip of metal or plastics material which can be severed from the web member 13, 14 and is narrow or wide in accordance with the progress of the construction. After each new setting up of the form for another section of the structure, appropriate strips may be removed on both sides at the edge portions of the supports 15, 16. However, it is also possible to make the support of a plastic or rubber material which can be severed or cut off in accordance with the progress of the construction and can be separated from the web member 13, 14. By using appropriate cutting tools, the required portion can be severed, so that the severed portion of the support 15, 16 can be removed from the web member.

It is particularly advantageous in this connection that the form plates 3, 4 can be made rectangular in their development, wherein the conical shape in structures having the shape of a cone or truncated cone or of a pyramid can be achieved solely by the overlapping at an acute angle of the web members 13, 14. This results in particular advantages also with respect to the outer appearance of the finished structure because a smooth surface is achieved and any visible portions of the web members extend exactly uniformly narrowing toward the top.

As FIG. 2 further shows, the support ring 5 for the inner form 1 carries a plumb line support cross 50 from which a plumb line is suspended toward an inner platform 51 supported below on the angular carrying members 19, 20. As a result, it is possible in a simple manner to check the exact vertical alignment of the structure during the entire progress of the construction. Thus, the form is to be adjusted already in accordance with the vertical progress of the structure.

FIG. 16 shows the cross-sectional shape of the structure having the shape of a truncated cone at the bottom and the highest location thereof, wherein the form plates 3, 4 and the web members 13, 14 as well as the support rings 5, 6 can be used without structural changes in the same manner for the entire range of diameters. This FIG. 16 also shows that a support framework 53 for the inner platform is supported on the inner angular carrying members 20. This support framework 53 has outwardly projecting arms 54 arranged in the manner of a cross, wherein these arms have upwardly projecting stirrups 55 in the region of the free ends of the arms, the stirrups 55 facilitating the insertion of extending pieces 56. Accordingly, either the arms 54 themselves or the extending pieces 56 can be supported on the carrying members 20. FIG. 1 and FIG. 2 further show that three support pipes 60 are provided over the entire circumference of the form framework. These support pipes 60 facilitate the further transport of the entire form to the next following section of the structure and, in addition, support a framework 61 for an outer platform 62. Additional carrying elements 63 may be sectioned on the form carriers 11 or 12 for receiving a platform 64 to walk on.

The upper ends of the form carriers 11, 12 are connected to each other in the conventional manner by a transverse connection 65, so that the spacing of the form plates 3, 4 can additionally be fixed.

After each section of the structure has been finished, the form is loosened in a simple manner by loosening the threaded spindles 7 to 10, so that the form plates and, thus, the form carriers 11, 12 can be slightly moved in radial direction. The entire form is then pulled upwardly to the next section of the structure, wherein a support of the form carriers 11, 12 is placed onto the carrier members 19, 20 arranged appropriately upwardly offset. After adjusting the vertical position of the form carriers 11, 12 and, thus, the form plates 3, 4, the wedges 28, 29 are inserted and the form can be adjusted to the new section of the structure by tightening or loosening and, thus, moving the threaded spindles 7 through 10.

Particularly if the structure has a relatively significant inclination, i.e., when the threaded spindles include an acute angle with the form carriers, it is advantageous to connect the threaded sleeves or nuts 39 through an articulated joint to the form carriers 11, 12, 23, 24.

In FIGS. 10 to 15, only the outer form components are shown. The inner form components are practically identical with respect to construction and design.

The vertical adjustment of the form can be carried out by a crane or by suspending from a vertically adjustable platform (inner platform or outer platform).

In the drawings, the support rings 5, 6 are shown as circular constructions. The support rings may also have different shapes, for example, with a polygonal or oval circumference. Thus, an adjustment of the support rings to structures having different cross-sectional shapes can be made.

The measures according to the invention not only ensure a simple and safe support of the form in the individual sections of the structure, but a simple and exact adjustment to changing generatrices of the structure, to changing plan shapes and to changing wall thickness is possible.

I claim:

1. An adjustable form for forming a structure, the form comprising an inner form and an outer form, a space being defined between the inner form and the outer form for forming the structure therein, the inner and the outer forms each having a plurality of spaced-apart form plates, each form plate having form plate edges and a rear side, web members being provided between adjacent form plates of the inner form and between adjacent form plates of the outer form, a first circumferentially closed, force-transmitting support ring being arranged horizontally spaced from and inside the inner form, a second circumferentially closed, force-transmitting support ring being arranged horizontally spaced from and outside the outer form, threaded spindles being mounted in the support rings, the threaded spindles being slidable in approximately horizontal direction, means for fixing the threaded spindles, each threaded spindle having an end engaging a form carrier, wherein a form carrier is mounted to each form plate and each web member, the web members engaging over the form plate edges at the rear sides of the form plates, wherein each web member has on a surface facing the space between the inner and outer forms a support which corresponds in thickness approximately to the thickness of the form plates, the supports extending between the form plate edges of adjacent spaced-apart form plates.

2. The form according to claim 1, wherein the form carriers extend approximately vertically, the form carriers resting on one of the ground and an already finished section of the structure.

3. The form according to claim 2, wherein angular carrier members are fastened on an already finished section of the structure, the form carriers being supported by the carrier members.

4. The form according to claim 3, wherein the angular carrier members have a U-shaped, upwardly widening insertion opening for receipt of the form carriers.

5. The form according to claim 4, wherein the form carriers have an underside, a vertically adjustable support member being placed on the angular carrier members and supporting the form carriers at the underside thereof.

6. The form according to claim 5, wherein the adjustable support member is a threaded spindle.

7. Form according to claim 6, wherein the adjustable support member is a screw.

8. The form according to claim 5, wherein each form plate has an underside, at least one form carrier being provided for each form plate, the at least one form carrier carrying an extending piece having a free end mounted adjacent the underside of a form plate and fixedly connected thereto, the free end of the extending piece carrying the adjustable support member.

9. The form according to claim 8, comprising compensating elements inserted between the extending pieces and a surface of an already finished section of the structure, the compensating elements aligning the form carrier in a direction which includes an angle with the vertical.

10. Form according to claim 9, wherein the compensating elements are wedges.

11. The form according to claim 3, wherein the support ring inside the inner form carries a plumb line carrying cross from which a plumb line is suspended toward an inner platform supported by the angular carrier members.

12. The form according to claim 1, wherein the support rings include two rails which extend spaced apart parallel one above the other and struts extending between the rails.

13. The form according to claim 12, wherein the rails of the support rings comprise two flat sections arranged spaced apart one above the other and sleeves which are arranged between the flat sections, the threaded spindles being inserted through the sleeve.

14. The form according to claim 12, wherein each support ring comprises at least two arc sections which are joined at joints located on the two rails, flanges being provided at the joints, a screw connection being provided at each joint for connecting the flanges.

15. The form according to claim 1, wherein the form carriers are I-beams, each I-beam having a first and a second flange, wherein the first flange is connected to one of the form plates and the web members and additional threaded sleeves for receiving one end of the threaded spindle are mounted on the second flange.

16. The form according to claim 10, wherein the threaded sleeves mounted on the form carriers are connected to the form carriers through an articulated joint.

17. The form according to claim 1, wherein each form carrier is centrally located on the rear side of a form plate, the form carrier being fixedly connected to the form plate.

18. Form according to claim 17, wherein the form carrier is welded to the form plate.

19. Form according to claim 17, wherein the form carrier is welded to the web member.

20. The form according to claim 1, wherein threaded bolts are mounted with a predetermined spacing one above the other at the form plate edges of the form plates, and wherein horizontally extending slots are provided with the same predetermined spacing on the web members, overlapping portions being provided between the form plates and the web members, the overlapping portions being clamped together by clamping means.

21. The form according to claim 20, wherein the threaded bolts are countersunk screws which are inserted in the form plate and project freely rearwardly.

22. The form according to claim 21, wherein spacer webs are placed between the form carriers and one of the form plates and the web members, the spacer webs being interrupted at the slots and the threaded bolts.

23. The form according to claim 1, wherein the form plates and the web members define overlapping portions, and wherein each support on the web members is a material which can be severed as the overlapping portion of the form plates and the web members become increasingly larger.

24. The form according to claim 1, wherein each support is formed by individual strips selected from the group consisting of metal, plastics material, and wood, the strips being severable from the web member, a spacing being defined between adjacent form work edges, wherein the size of the strips is selected in accordance with the spacing between the form plate edges.

25. The form according to claim 1, wherein each support is of a material which can be severed and separated from the web member.

26. Form according to claim 25, wherein the material of the support is selected from the group consisting of plastic and rubber.

27. The form according to claim 1, wherein the form plates are rectangular, the web members having side edges, an acute angle being defined between each form plate edge and the side edge of the overlapping web member.

* * * * *